US011614285B2

(12) United States Patent
Huang et al.

(10) Patent No.: US 11,614,285 B2
(45) Date of Patent: Mar. 28, 2023

(54) INTERLACED HEAT EXCHANGER

(71) Applicant: Johnson Controls Technology Company, Auburn Hills, MI (US)

(72) Inventors: Zhiwei Huang, Moore, OK (US); Neelkanth S. Gupte, Katy, TX (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 17/360,954

(22) Filed: Jun. 28, 2021

(65) Prior Publication Data

US 2021/0325115 A1 Oct. 21, 2021

Related U.S. Application Data

(63) Continuation of application No. 16/040,269, filed on Jul. 19, 2018, now Pat. No. 11,047,625.
(Continued)

(51) Int. Cl.
*F28D 1/04* (2006.01)
*F28D 1/053* (2006.01)
(Continued)

(52) U.S. Cl.
CPC ..... *F28D 1/0417* (2013.01); *F28D 1/0473* (2013.01); *F28D 1/05341* (2013.01); *F28D 1/05391* (2013.01); *F28D 2021/007* (2013.01); *F28D 2021/0071* (2013.01); *F28F 2260/02* (2013.01)

(58) Field of Classification Search
CPC .. F28D 1/0417; F28D 1/0473; F28D 1/05341; F28D 1/05391; F28D 1/0471; F28F 2009/0287; F28F 2210/04
See application file for complete search history.

(56) References Cited

U.S. PATENT DOCUMENTS 2,286,271 A 6/1942 Higham
2,883,165 A 4/1959 Jensen et al.
(Continued)

FOREIGN PATENT DOCUMENTS

CN 103644685 A * 3/2014 ..... F28D 21/00
CN 103644685 A 3/2014
(Continued)

OTHER PUBLICATIONS

CN-103644685-A translation.*
(Continued)

*Primary Examiner* — Jon T. Schermerhorn, Jr.
(74) *Attorney, Agent, or Firm* — Fletcher Yoder, P.C.

(57) ABSTRACT

Embodiments of the present disclosure are directed to a climate management system that includes a heat exchanger having a first set of microchannel coils fluidly coupled to a first circuit of the climate management system and a second set of microchannel coils fluidly coupled to a second circuit of the climate management system, where the first circuit and the second circuit are fluidly separate from one another, and where the first set of microchannel coils and the second set of microchannel coils are disposed in an alternating arrangement along a length of the heat exchanger such that the first set of microchannel coils and the second set of microchannel coils are interlaced in the heat exchanger.

20 Claims, 10 Drawing Sheets

Related U.S. Application Data

(60) Provisional application No. 62/678,087, filed on May 30, 2018.

(51) Int. Cl.
*F28D 1/047* (2006.01)
*F28D 21/00* (2006.01)

(56) References Cited

U.S. PATENT DOCUMENTS

| | | | | |
|---|---|---|---|---|
| 3,433,298 | A * | 3/1969 | Vollhardt | F28F 1/04 165/134.1 |
| 5,101,890 | A | 4/1992 | Aoki et al. | |
| 5,314,013 | A | 5/1994 | Tanabe | |
| 5,941,303 | A | 8/1999 | Gowan et al. | |
| 5,967,228 | A | 10/1999 | Bergman et al. | |
| 6,644,393 | B2 | 11/2003 | Roberts et al. | |
| 6,827,139 | B2 | 12/2004 | Kawakubo et al. | |
| 6,991,026 | B2 | 1/2006 | Costen et al. | |
| 7,108,049 | B2 | 9/2006 | Makino et al. | |
| 7,135,863 | B2 | 11/2006 | Arik et al. | |
| 7,273,093 | B2 | 9/2007 | Durr et al. | |
| 7,503,382 | B2 * | 3/2009 | Maezawa | F28F 9/0275 165/144 |
| 7,942,020 | B2 * | 5/2011 | Knight | F28D 1/05391 62/519 |
| 8,166,776 | B2 * | 5/2012 | Kopko | F25B 41/30 62/507 |
| 8,272,233 | B2 * | 9/2012 | Yoshimura | F28F 9/0246 62/513 |
| 8,561,427 | B2 | 10/2013 | Knight et al. | |
| 8,739,855 | B2 | 6/2014 | Fritz et al. | |
| 2003/0102112 | A1 | 6/2003 | Smithey et al. | |
| 2003/0178188 | A1 * | 9/2003 | Coleman | F28F 1/022 165/164 |
| 2005/0198995 | A1 * | 9/2005 | Lee | F28D 5/00 62/506 |
| 2005/0279127 | A1 * | 12/2005 | Jia | F25B 1/10 62/507 |
| 2006/0048928 | A1 * | 3/2006 | Maezawa | F28F 1/025 165/173 |
| 2008/0092587 | A1 * | 4/2008 | Gorbounov | F28F 9/028 165/104.21 |
| 2008/0148746 | A1 | 6/2008 | Yanik et al. | |
| 2011/0056667 | A1 * | 3/2011 | Taras | F28D 1/05391 165/173 |
| 2011/0079032 | A1 * | 4/2011 | Taras | F24F 3/153 62/324.2 |
| 2011/0132585 | A1 | 6/2011 | Chen et al. | |
| 2011/0168362 | A1 | 7/2011 | Hall et al. | |
| 2012/0011867 | A1 * | 1/2012 | Koons | F28D 1/0443 165/165 |
| 2012/0096894 | A1 | 4/2012 | Higashiyama et al. | |
| 2015/0021003 | A1 | 1/2015 | Cho et al. | |
| 2015/0168072 | A1 | 6/2015 | Ueno et al. | |
| 2016/0201990 | A1 | 7/2016 | Voorhis, Jr. et al. | |
| 2016/0290730 | A1 | 10/2016 | Taras | |
| 2017/0146299 | A1 | 5/2017 | Steinbach et al. | |
| 2017/0211889 | A1 | 7/2017 | Schwalm | |
| 2017/0284749 | A1 | 10/2017 | Smith et al. | |
| 2017/0343288 | A1 | 11/2017 | Joardar | |
| 2017/0363361 | A1 * | 12/2017 | Turney | F28F 9/0202 |
| 2018/0299171 | A1 * | 10/2018 | Olsen | F28F 9/0202 |
| 2019/0049194 | A1 * | 2/2019 | Yanik | F28F 1/126 |
| 2019/0212063 | A1 * | 7/2019 | Mila | F25B 39/028 |
| 2021/0215431 | A1 * | 7/2021 | Joardar | F28D 1/0471 |

FOREIGN PATENT DOCUMENTS

| | | | | |
|---|---|---|---|---|
| CN | 104913548 | A | 9/2015 | |
| CN | 107218822 | B | 4/2019 | |
| EP | 2229572 | B1 | 3/2014 | |
| EP | 3126767 | A2 | 2/2017 | |
| JP | 2012202609 | A * | 10/2012 | F28D 7/0025 |
| JP | 2012202609 | A | 10/2012 | |
| WO | 2015155611 | A2 | 10/2015 | |

OTHER PUBLICATIONS

JP-2012202609-A translation.*

Shah, R. K. et al., Compact Heat Exchangers, 1990, pp. 1-4, Hemisphere Publishing Corporation, United States of America.

R. L. Webb et al., Design of Light Weigh Heat Exchangers for Air to Two-Phase Service, Compact Heat Exchangers, 1990, 5 pages, Hemisphere Publishing Corporation.

Danfoss, Three Danfoss Technologies Named Winners of 2020 AHR Expo Innovation Awards, https://www.danfoss.com/en/about-danfoss/news/dcs/three-danfoss-technologies-named-winners-of-2020-ahr-expo-innovation-awards/, Oct. 10, 2019, 4 pages.

Danfoss, Increased Savings with MicroChannel Heat Exchangers, https://assets.danfoss.com/documents/DOC137686438163/DOC137686438163.pdf, Sep. 2014, 36 pages.

Sanhua Micro Channel MCHE, https://www.youtube.com/watch?time_continue=1&v=9VXPAT2D9I&feature=emb_logo, Aug. 20, 2013, SanhuaEurope, 7:06 minutes.

Sanhua, Micro-Channel Heat Exchangers-Standard Range, https://www.sanhuaeurope.com/static/uploads/files/catalogue/Standard_MCHE_VersionWeb.pdf, 2014, 15 pages.

Sanhua, Micro-Channel Heat Exchangers, https://www.zjshc.com/static/uploads/files/catalogue/mche-brochureupdate-2017-web.pdf, 2017, 74 pages.

* cited by examiner

INTERLACED HEAT EXCHANGER

CROSS REFERENCE TO RELATED APPLICATIONS

This is a continuation application of U.S. patent application Ser. No. 16/040,269, entitled "INTERLACED HEAT EXCHANGER," filed Jul. 19, 2018, which claims priority from and the benefit of U.S. Provisional Application No. 62/678,087, entitled "INTERLACED HEAT EXCHANGER," filed May 30, 2018, each of which is hereby incorporated by reference in its entirety for all purposes.

BACKGROUND

The present disclosure relates generally to environmental control systems, and more particularly, to a heat exchanger for a heating, ventilation, and air conditioning (HVAC) unit.

Environmental control systems are utilized in residential, commercial, and industrial environments to control environmental properties, such as temperature and humidity, for occupants of the respective environments. The environmental control system may control the environmental properties through control of an airflow delivered to the environment. In some cases, environmental control systems include a heat exchanger that is configured to exchange thermal energy, such as heat, between a working fluid flowing through conduits or coils of the heat exchanger and an airflow flowing across the conduits or coils. Some environmental control systems may include multiple circuits that may be selectively operated to increase or decrease a capacity of the environmental control system. Accordingly, some existing systems include multiple heat exchangers corresponding to respective circuits of the environmental control system. In some cases, the multiple heat exchangers are separated by a divider panel within a housing of the system. Alternatively, some systems position heat exchangers side-by-side or in a stacked arrangement. Unfortunately, dividing the multiple heat exchangers and/or arranging the heat exchangers adjacent to one another may leave a portion of a heat exchange surface area unused during partial load conditions, which may reduce an efficiency of the environmental control system.

DRAWINGS

SUMMARY

Figure 1:
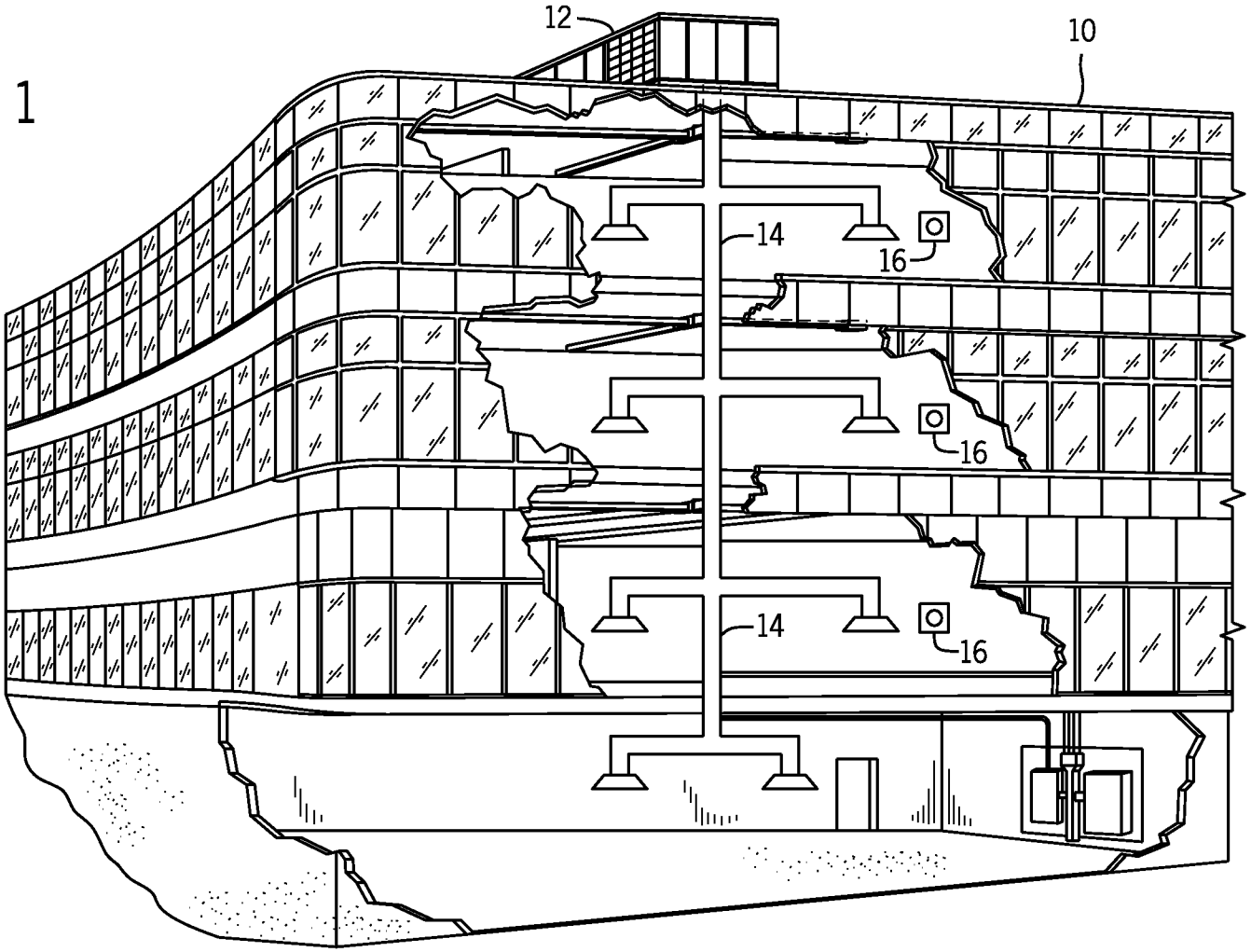
FIG. 1 is a schematic of an environmental control for building environmental management that may employ an HVAC unit, in accordance with an aspect of the present disclosure.

In one embodiment of the present disclosure, a climate management system includes a heat exchanger having a first set of microchannel coils fluidly coupled to a first circuit of the climate management system and a second set of microchannel coils fluidly coupled to a second circuit of the climate management system, where the first circuit and the second circuit are fluidly separate from one another, and where the first set of microchannel coils and the second set of microchannel coils are disposed in an alternating arrangement along a length of the heat exchanger such that the first set of microchannel coils and the second set of microchannel coils are interlaced in the heat exchanger.

In another embodiment of the present disclosure, an interlaced heat exchanger includes a first set of microchannel tubes fluidly configured to fluidly couple to a first working fluid circulation loop, a second set of microchannel tubes configured to fluidly couple to a second working fluid circulation loop, where the first working fluid circulation loop and the second working fluid circulation loop are fluidly separate from one another, and where the first set of microchannel tubes and the second set of microchannel tubes are disposed in an alternating arrangement along a length of the interlaced heat exchanger such that the first set of microchannel tubes and the second set of microchannel tubes are interlaced, and a header fluidly coupled to a first header connection of a first microchannel tube of the first set of microchannel tubes and fluidly coupled to a second header connection of a second microchannel tube of the second set of microchannel tubes.

In a further embodiment of the present disclosure, a climate management system includes a first working fluid circulation loop configured to circulate a first working fluid through a first set of microchannel coils of a heat exchanger and a second working fluid circulation loop configured to circulate a second working fluid through a second set of microchannel coils of the heat exchanger, where the first working fluid circulation loop and the second working fluid circulation loop are fluidly separate from one another, and where the first set of microchannel coils and the second set of microchannel coils are disposed in an alternating arrangement along a length of the heat exchanger such that the first set of microchannel coils and the second set of microchannel coils are interlaced in the heat exchanger.

Other features and advantages of the present application will be apparent from the following, more detailed description of the embodiments, taken in conjunction with the accompanying drawings which illustrate, by way of example, the principles of the application.

DETAILED DESCRIPTION

The present disclosure is directed to an interlaced heat exchanger having microchannel coils, or microchannel tubes. Existing systems that include multiple circuits for circulating a working fluid may include multiple, separate heat exchanger coils. In some cases, existing systems may separate the heat exchanger coils via a divider panel. In other existing systems, the heat exchanger coils are positioned side-by-side or in a stacked arrangement. As discussed above, existing configurations of heat exchanger coils for multiple circuit systems may leave a portion of a heat exchange surface area left unused, such that an efficiency of the system is reduced during partial load conditions. For example, when two heat exchanger coils are positioned adjacent to one another, but only one of the heat exchanger coils is in operation, an airflow may still be drawn across both heat exchanger coils, thereby essentially wasting a heat exchange surface area of the non-operational heat exchanger coil. Further, divider panels to separate airflows across multiple heat exchanger coils may add capital and assembly costs to the system.

Accordingly, embodiments of the present disclosure are directed to an interlaced heat exchanger having microchannel coils, or microchannel tubes, that increases an efficiency of a multiple circuit system. As used herein, a multiple circuit system refers to a system that includes multiple, closed loop circuits that are fluidly separate from one another, or configured to separately circulate separate working fluids through individual circulation loops that each have a heat exchanger. In some embodiments, the interlaced heat exchanger increases a heat exchange surface area that is utilized when another circuit is not operating. Further, the interlaced heat exchanger may more evenly distribute an amount of thermal energy transfer to an airflow across the interlaced heat exchanger when compared to traditional side-by-side or stacked heat exchanger coil arrangements. For instance, an airflow across a non-operational heat exchanger coil in a side-by-side or stacked arrangement may engage in little thermal energy transfer, and thus, a temperature differential is established between airflow across the non-operational heat exchanger coil and the heat exchanger coil in operation. The interlaced heat exchanger enables substantially all of an airflow to be in a heat exchange relationship with an operating circuit when a second circuit is non-operational, without the use of a divider panel. Further still, the interlaced heat exchanger enables simplification of a control algorithm for a fan utilized to force or draw the airflow across the heat exchanger. Some existing systems utilize multiple fans that are controlled based on which circuit of the system is in operation. Accordingly, operating a single fan or multiple fans regardless of which circuit is in operation may simplify the fan control algorithm and increase efficiency.

In some embodiments, the interlaced heat exchanger includes a first set of microchannel coils corresponding to a first working fluid circuit and a second set of microchannel coils corresponding to a second working fluid circuit. As used herein, a microchannel coil, or a microchannel tube, refers to a heat exchanger conduit having a plurality of channels or passageways formed in a common housing or body of the heat exchanger conduit. The first set of microchannel coils and the second set of microchannel coils may be arranged in an alternating pattern or arrangement along an axis defining a length of the interlaced heat exchanger. Additionally, a plurality of fins may be disposed between adjacent microchannel coils to increase a heat exchange surface area that an airflow passing across the interlaced heat exchanger contacts.

As used herein, an alternating pattern or arrangement may include a first microchannel coil of the first set of microchannel coils arranged in between two second microchannel coils of the second set of microchannel coils. Additionally, the alternating pattern or arrangement may also include a sequence of a first subset of microchannel coils of the first set of microchannel coils positioned between second subsets of the second set of microchannel coils. For instance, the alternating pattern or arrangement may include a sequence, such as 1, 1, 2, 2, 1, 1, 2, 2, and so forth, where the number "1" represents a microchannel coil of the first set of microchannel coils and the number "2" represents a microchannel coil of the second set of microchannel coils. Additionally, the alternating pattern or arrangement may include a sequence of groups of the first set of microchannel coils and groups of the second set of microchannel coils, where the groups of the first set of microchannel coils includes a different number of microchannel coils than the groups of the second set of microchannel coils. For example, the alternating pattern or arrangement may include a sequence, such as 1, 1, 1, 2, 1, 1, 1, 2, and so forth, where the number "1" represents a microchannel coil of the first set of microchannel coils and the number "2" represents a microchannel coil of the second set of microchannel coils. In still further embodiments, the alternating pattern or arrangement may include more than two sets of microchannel coils. For instance, the alternating pattern or arrangement may include a sequence such as 1, 1, 2, 2, 3, 3, 1, 1, 2, 2, 3, 3, and so forth, where the number "1" represents a microchannel coil of the first set of microchannel coils, the number "2" represents a microchannel coil of the second set of microchannel coils, and the number "3" represents a microchannel coil of a third set of microchannel coils. In any case, the alternating pattern or arrangement may interlace microchannel coils fluidly coupled to respective circuits of a multiple circuit system to increase a heat exchange surface area that an airflow is exposed to when a given circuit, or circuits, is in operation.

In some embodiments, the first set of microchannel coils may be fluidly coupled to first and second headers, where the first header directs a first working fluid into the first set of microchannel coils, and the second header receives the first working fluid from the first set of microchannel coils and directs the first working fluid toward another component of the first circuit. Similarly, the second set of microchannel coils may be fluidly coupled to third and fourth headers, where the third header directs a second working fluid into the second set of microchannel coils, and the fourth header receives the second working fluid from the second set of microchannel coils and directs the second working fluid toward another component of the second circuit. In some embodiments, the first header and the third header may be integrated with one another, such that the first header and the third header form a first header assembly. Additionally or alternatively, the second header and the fourth header may be integrated with one another to form a second header assembly. In other embodiments, the first header, the second header, the third header, and/or the fourth header may be integral or separate from one another in any suitable combination. In some embodiments, the first set of microchannel coils and/or the second set of microchannel coils may be twisted, bent, or otherwise manipulated to fluidly couple the first set of microchannel coils with the first and second headers and to fluidly couple the second set of microchannel coils with the third and fourth headers.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
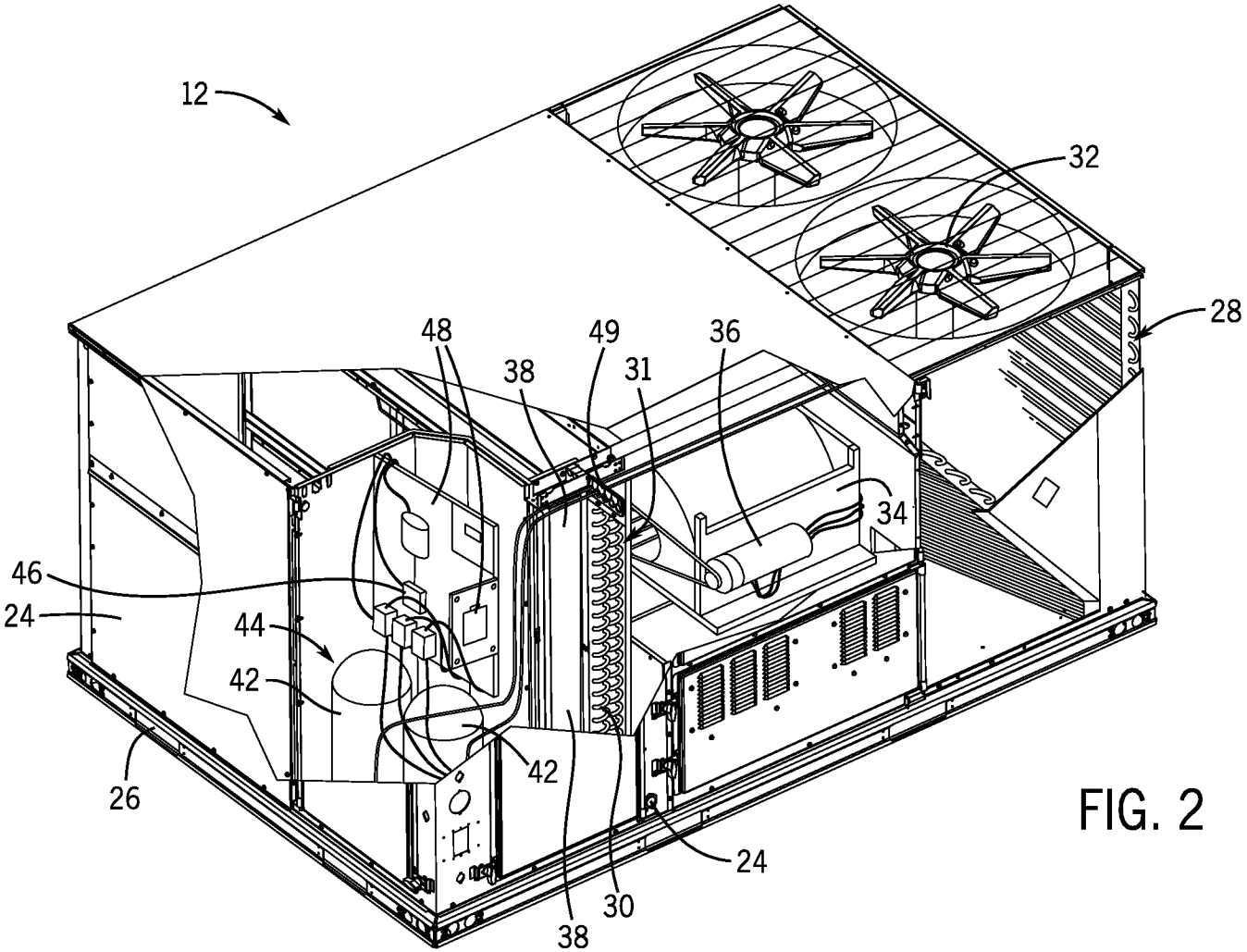
FIG. 2 is a perspective view of an embodiment of an HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
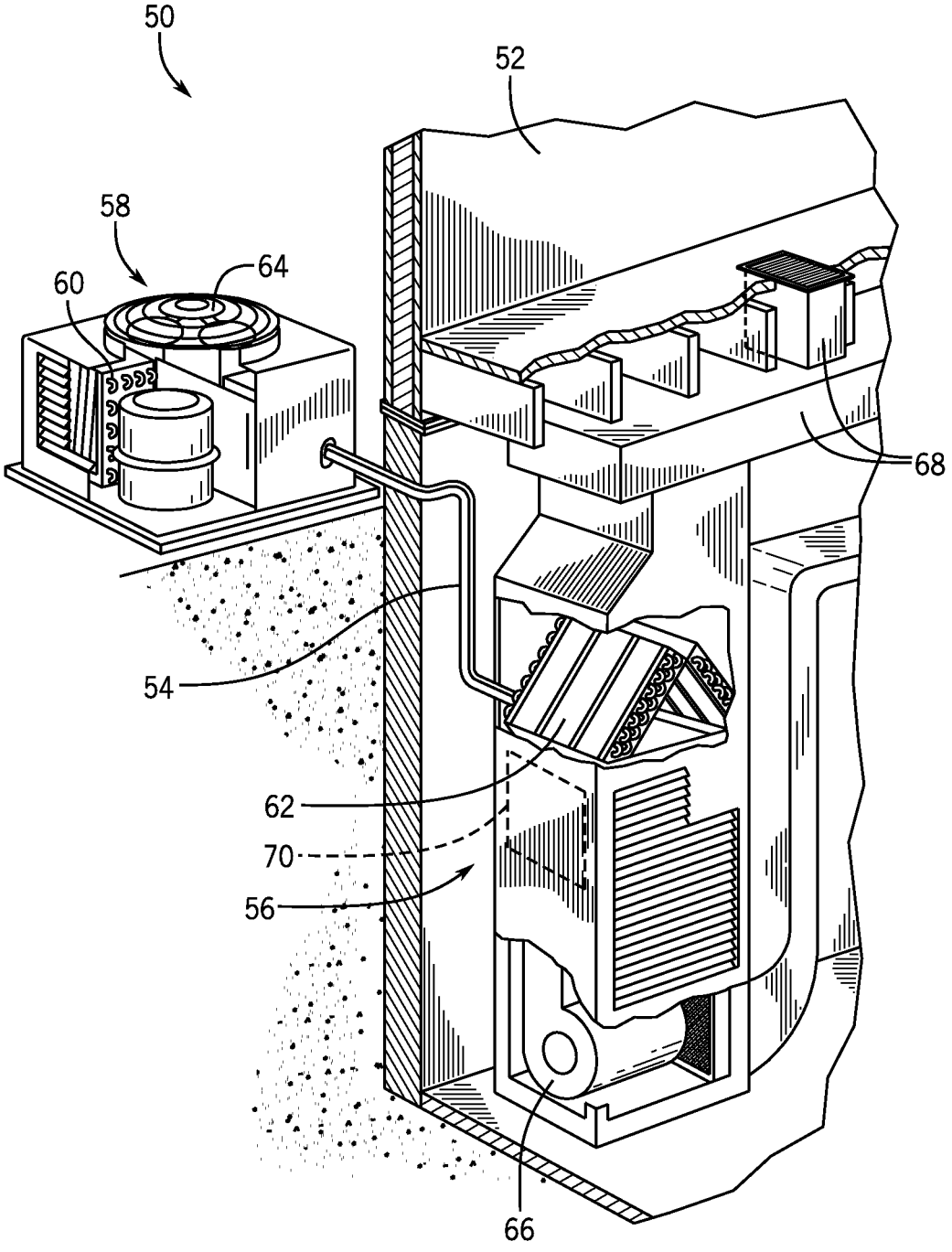
FIG. 3 is a schematic of an embodiment of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
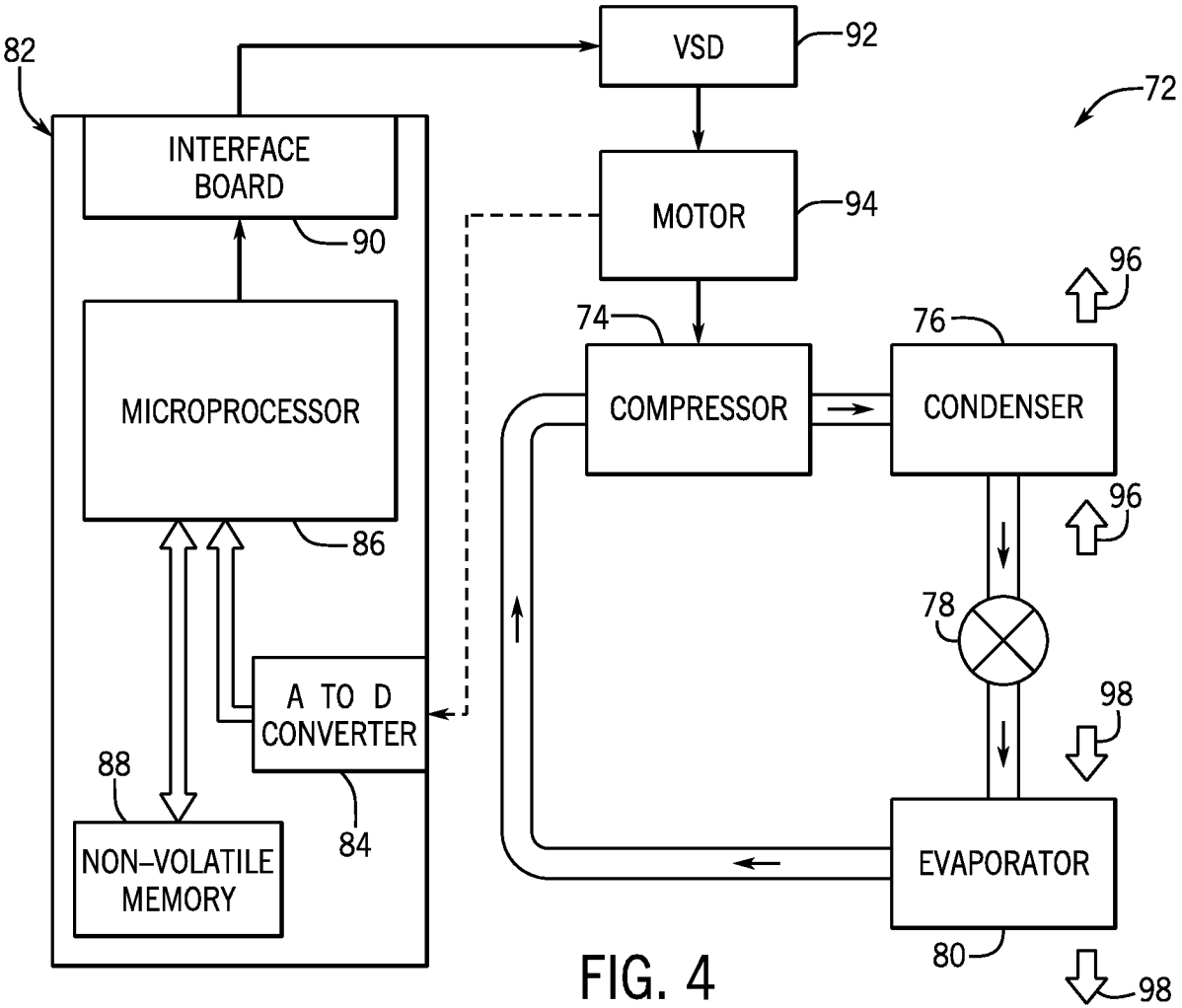
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an interlaced heat exchanger that is configured to increase an efficiency and/or a capacity of a multiple circuit system. As used herein, an interlaced heat exchanger refers to a heat exchanger that shares a heat exchange surface area between first coils that are fluidly coupled to a first working fluid circuit and second coils that are fluidly coupled to a second working fluid circuit. In other words, regardless of whether the first working fluid circuit or the second working fluid circuit, or both, is in operation, an airflow across the interlaced heat exchanger may contact substantially all of the heat exchange surface area associated with both the first coils and the second coils. As used herein, the heat exchange surface area refers to tubes of the first coils and the second coils, fins extending from or between the first and second coils, and/or other suitable passageways configured to flow working fluid through the first working fluid circuit and/or the second working fluid circuit. While the present discussion focuses on an interlaced heat exchanger in a dual circuit system, or a system having a first working fluid circuit and a second working fluid circuit, embodiments of the present disclosure may be utilized for systems that include three circuits, four circuits, five circuits, six circuits, seven circuits, eight circuits, nine circuits, ten circuits, or more than ten circuits.

Figure 5:
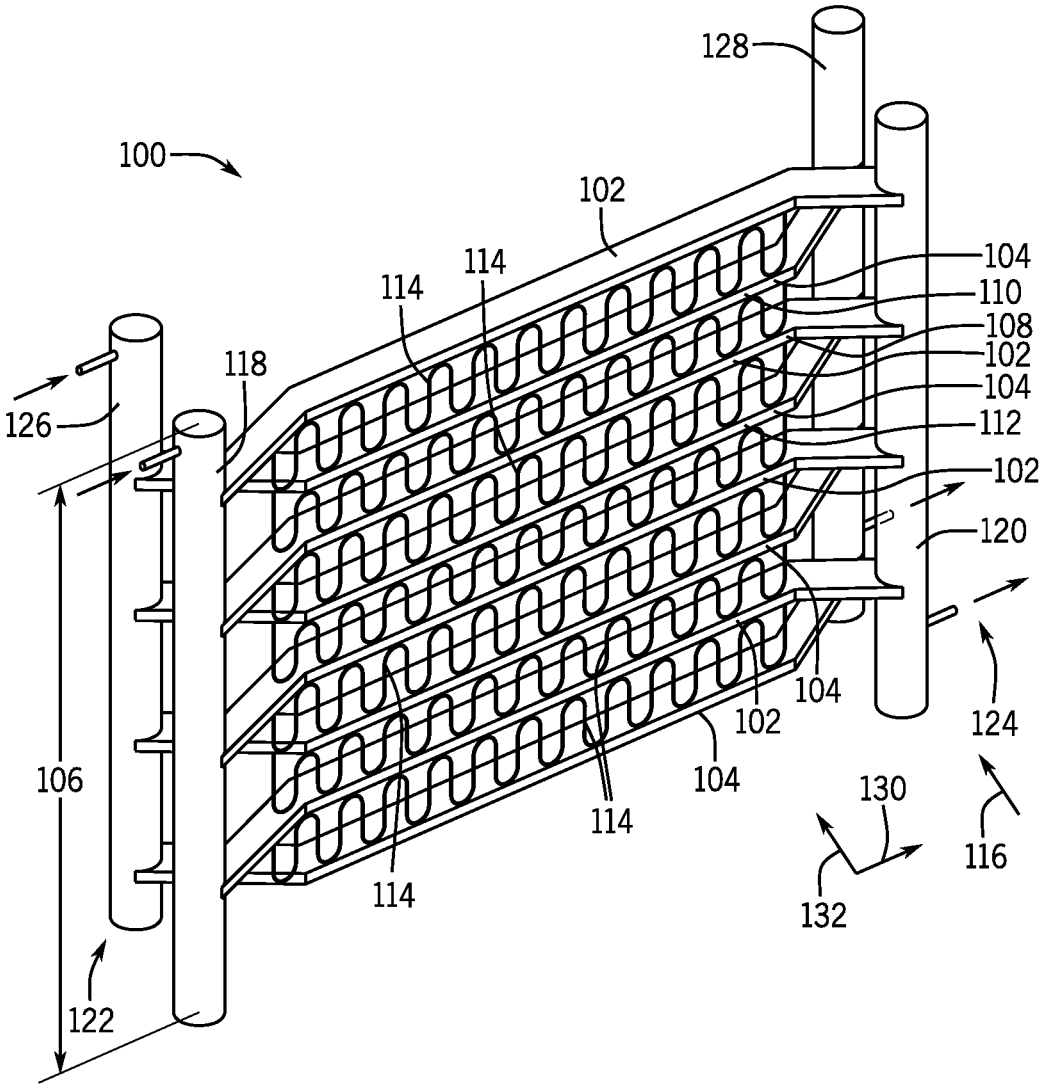
FIG. 5 is a perspective view of an embodiment of an interlaced heat exchanger that may be used with the systems of FIGS. 1-4, in accordance with an aspect of the present disclosure.

FIG. 5 is a perspective view of an embodiment of an interlaced heat exchanger 100 that is configured to increase an efficiency of a multiple working fluid circuit system. As shown in the illustrated embodiment of FIG. 5, the interlaced heat exchanger 100 includes a first set of microchannel coils 102 and a second set of microchannel coils 104. The first set of microchannel coils 102 may be fluidly coupled to a first working fluid circulation loop, and the second set of microchannel coils 104 may be fluidly coupled to a second working fluid circulation loop, where the first and second working fluid circulation loops are fluidly separate from one another. The first set of microchannel coils 102 and the second set of microchannel coils 104 are positioned in an alternating arrangement along a length 106, or height, of the interlaced heat exchanger 100. In other words, a first microchannel coil 108 of the first set of microchannel coils 102 is positioned adjacent to a second microchannel coil 110 and a third microchannel coil 112 of the second set of microchannel coils 104. The remaining microchannel coils of the first set of microchannel coils 102 and the second set of microchannel coils 104 of the interlaced heat exchanger 100 are arranged in a similar alternating manner.

The alternating arrangement of the first set of microchannel coils 102 and the second set of microchannel coils 104 may increase an efficiency of the multiple circuit system. For instance, a plurality of fins 114 is disposed between adjacent coils of the first set of microchannel coils 102 and the second set of microchannel coils 104. Accordingly, a fin of the plurality of fins 114 is coupled to both a microchannel coil of the first set of microchannel coils 102 and a microchannel coil of the second set of microchannel coils 104. Regardless of whether working fluid is circulating through one set of the first set of microchannel coils 102 and the second set of microchannel coils 104, the plurality of fins 114 will facilitate thermal energy transfer between working fluid flowing through the first set of microchannel coils 102 or the second set of microchannel coils 104. In other words, an airflow 116 flowing across the first set of microchannel coils 102 and the second set of microchannel coils 104 exchanges thermal energy with the plurality of fins 114 even when working fluid circulates through only the first set of microchannel coils 102 or only through the second set of microchannel coils 104. As such, an efficiency of the multiple circuit system is increased.

As set forth above, the first set of microchannel coils 102 is fluidly coupled to a first working fluid circulation loop, and the second set of microchannel coils 104 is coupled to a second working fluid circulation loop, where the first working fluid circulation loop and the second working fluid circulation loop are fluidly separate. As shown in the illustrated embodiment of FIG. 5, the first set of microchannel coils 102 is fluidly coupled to a first header 118 and a second header 120, where the first header 118 is positioned on a first end 122 of the interlaced heat exchanger 100, and the second header 120 is positioned on a second end 124 of the interlaced heat exchanger 100, opposite the first end 122. As such, the first header 118 may receive working fluid from a component of the first working fluid circulation loop and direct the working fluid into the first set of microchannel coils 102. The second header 120 receives the working fluid from the first set of microchannel coils 102 and directs the working fluid back toward the component of the first working fluid circulation loop or another component of the first working fluid circulation loop. Similarly, the second set of microchannel coils 104 is fluidly coupled to a third header 126 and a fourth header 128, where the third header 126 is positioned on the first end 122 of the interlaced heat exchanger 100, and the fourth header 128 is positioned on the second end 124 of the interlaced heat exchanger 100. As such, the third header 126 may receive working fluid from a component of the second working fluid circulation loop and direct the working fluid into the second set of microchannel coils 104. The fourth header 128 receives the working fluid from the second set of microchannel coils 104 and directs the working fluid back toward the component of the second working fluid circulation loop or another component of the second working fluid circulation loop.

As shown in the illustrated embodiment of FIG. 5, the first header 118 and the third header 126 are positioned offset from one another relative to an axis 130 along which the first set of microchannel coils 102 and the second set of microchannel coils 104 extend and relative to an axis 132 along which the airflow 116 is directed across the interlaced heat exchanger 100. Similarly, the second header 120 and the fourth header 128 are positioned offset from one another relative to both the axes 130, 132. Offsetting the first header 118 and the third header 126 as well as offsetting the second header 120 and the fourth header 128 in this manner may facilitate coupling the first set of microchannel coils 102 and the second set of microchannel coils 104 to the first header 118, the second header 120, the third header 126, and/or the fourth header 128, as desired. For instance, the first set of microchannel coils 102 and/or the second set of microchannel coils 104 may be twisted, or otherwise manipulated, to enable the first set of microchannel coils 102 and the second set of microchannel coils 104 to be fluidly coupled to the corresponding headers 118, 120, 126, 128 without interference by other coils or headers of the interlaced heat exchanger 100.

Figure 6:
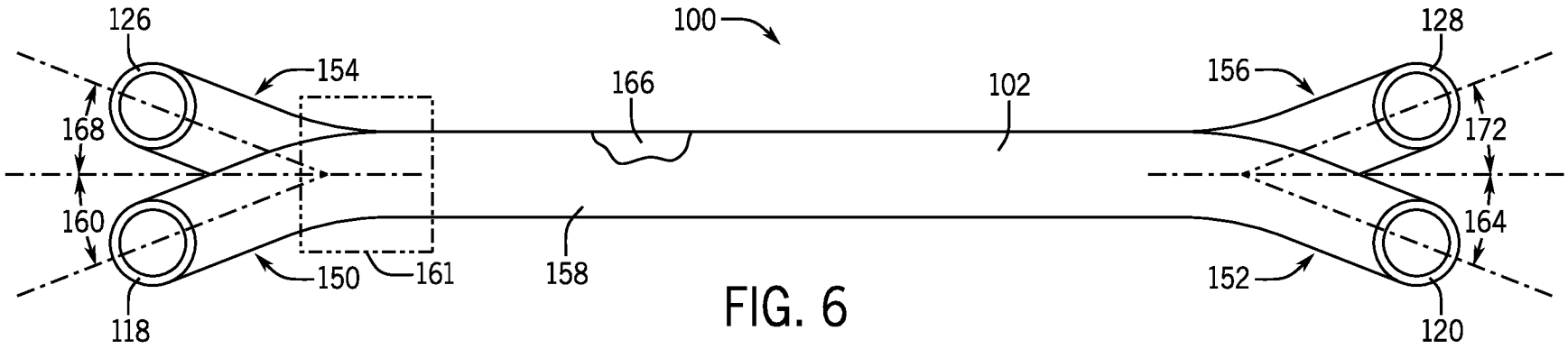
FIG. 6 is a plan view of an embodiment of an interlaced heat exchanger, in accordance with an aspect of the present disclosure.

FIG. 6 is a plan view of an embodiment of an interlaced heat exchanger, such as the interlaced heat exchanger 100 of FIG. 5. For purposes of discussion and clarity, the embodiment of FIG. 6 includes similar elements and element numbers as the embodiment shown in FIG. 5. As shown in the illustrated embodiment of FIG. 6, each microchannel coil of the first set of microchannel coils 102 includes a first header connection 150 and a second header connection 152. Further, each microchannel coil of the second set of microchannel coils 104 include a third header connection 154 and a fourth header connection 156. In order to couple the first header connection 150 to the first header 118, the first header connection 150 is twisted with respect to a body portion 158 of a respective microchannel coil of the first set of microchannel coils 102. In other words, the first header connection 150 may form an angle 160 with respect to the body portion 158 to enable the respective microchannel coil to be coupled to the first header 118. In some embodiments, the angle 160 may be between 10 degrees and 170 degrees, between 20 degrees and 150 degrees, or between 30 degrees and 120 degrees. While the first header connection 150 is twisted with respect to the body portion 158, the first header connection 150 may remain in substantially the same plane 161 as the body portion 158.

Similarly, to couple the second header connection 152 to the second header 120, the second header connection 152 is twisted with respect to the body portion 158 of a respective microchannel coil of the first set of microchannel coils 102. In other words, the second header connection 152 may form an angle 164 with respect to the body portion 158 to enable the respective microchannel coil to be coupled to the second header 120. In some embodiments, the angle 164 may be between 10 degrees and 170 degrees, between 20 degrees and 150 degrees, or between 30 degrees and 120 degrees. While the second header connection 152 is twisted with respect to the body portion 158, the second header connection 152 may remain in substantially the same plane as the body portion 158. Further, in some embodiments, the angle 164 may be substantially equal to the angle 160. In other embodiments, the angles 160, 164 may be different from one another.

To couple the third header connection 154 to the third header 126, the third header connection 154 is twisted with respect to a body portion 166 of a respective microchannel coil of the second set of microchannel coils 104. In other words, the third header connection 154 may form an angle 168 with respect to the body portion 166 to enable the respective microchannel coil to be coupled to the third header 126. In some embodiments, the angle 168 may be between 10 degrees and 170 degrees, between 20 degrees and 150 degrees, or between 30 degrees and 120 degrees. While the third header connection 154 is twisted with respect to the body portion 166, the third header connection 154 may remain in substantially the same plane as the body portion 166. Further, in some embodiments, the angle 168 may be substantially equal to the angles 160, 164. In other embodiments, the angles 160, 164, 168 may be different from one another.

Further, to couple the fourth header connection 156 to the fourth header 128, the fourth header connection 156 is twisted with respect to a body portion 166 of a respective microchannel coil of the second set of microchannel coils 104. In other words, the fourth header connection 156 may form an angle 172 with respect to the body portion 166 to enable the respective microchannel coil to be coupled to the fourth header 128. In some embodiments, the angle 172 may be between 10 degrees and 170 degrees, between 20 degrees and 150 degrees, or between 30 degrees and 120 degrees. While the fourth header connection 156 is twisted with respect to the body portion 166, the fourth header connection 156 may remain in substantially the same plane as the body portion 166. Further, in some embodiments, the angle 172 may be substantially equal to the angles 160, 164, 168. In other embodiments, the angles 160, 164, 168, 172 may be different from one another. In any case, the angles 160, 164, 168, 172 may be any suitable angle that facilitates connecting the first header connection 150, the second header connection 152, the third header connection 154, and the fourth header connection 156 to the first header 118, the second header 120, the third header 126, and the fourth header 128, respectively.

Figure 7:
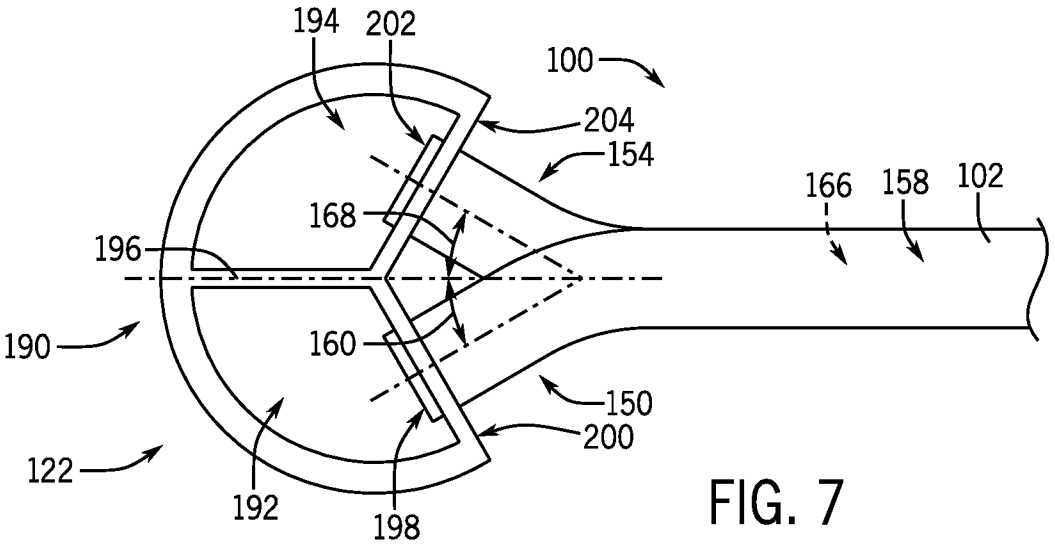
FIG. 7 is a plan view of an embodiment of an interlaced heat exchanger having an integrated header, in accordance with an aspect of the present disclosure.

While the embodiments of the interlaced heat exchangers 100 of FIGS. 5 and 6 include the four headers 118, 120, 126, 128, in other embodiments, the interlaced heat exchanger 100 may include two headers that have multiple passageways. For example, FIG. 7 is a plan view of an embodiment of the interlaced heat exchanger 100 having an integrated header 190 in place of the first header 118 and the third header 126, for example. It should be understood that while FIG. 7 illustrates the first end 122 of the interlaced heat exchanger 100, the second end 124 of the interlaced heat exchanger 100 may also include an integrated header in place of the second header 120 and the fourth header 128.

As shown in the illustrated embodiment of FIG. 7, the first header connection 150 is fluidly coupled to a first passage 192 of the integrated header 190. Further, the third header connection 154 is fluidly coupled to a second passage 194 of the integrated header 190. The first passage 192 and the second passage 194 are separated from one another by a divider 196, such that the working fluid flowing through the first passage 192, and therefore through the first set of microchannel coils 102, is isolated or fluidly separate from the working fluid flowing through the second passage 194, and therefore through the second set of microchannel coils 104.

In some embodiments, the first header connection 150 is twisted to form the angle 160 between the first header connection 150 and the body portion 158. As such, a surface 198 of the first header connection 150 may be substantially parallel or aligned with a first surface 200 of the integrated header 190. Similarly, the third header connection 154 may be twisted to form the angle 168 between the third header connection 154 and the body portion 166. As such, a surface 202 of the third header connection 154 may be substantially parallel or aligned with a second surface 204 of the integrated header 190. However, in other embodiments, the surfaces 198, 200 and/or the surfaces 202, 204 may be arcuate or have other corresponding contours to enable the surfaces 198, 200 and/or the surfaces 202, 204 to couple to one another.

While the integrated header 190 of FIG. 7 includes a circular sector cross-sectional shape, it should be understood that the integrated header 190 may include any suitable cross-sectional shape, such as circular, rectangular, square, polygonal, or another suitable shape. Further, in some embodiments, the first passage 192 and the second passage 194 of the integrated header 190 may be substantially equal in cross-sectional area, as shown in FIG. 7. In other embodiments, the first passage 192 and the second passage 194 may include different cross-sectional areas depending on a capacity of the first working fluid circuit and the second working fluid circuit.

Figure 8:
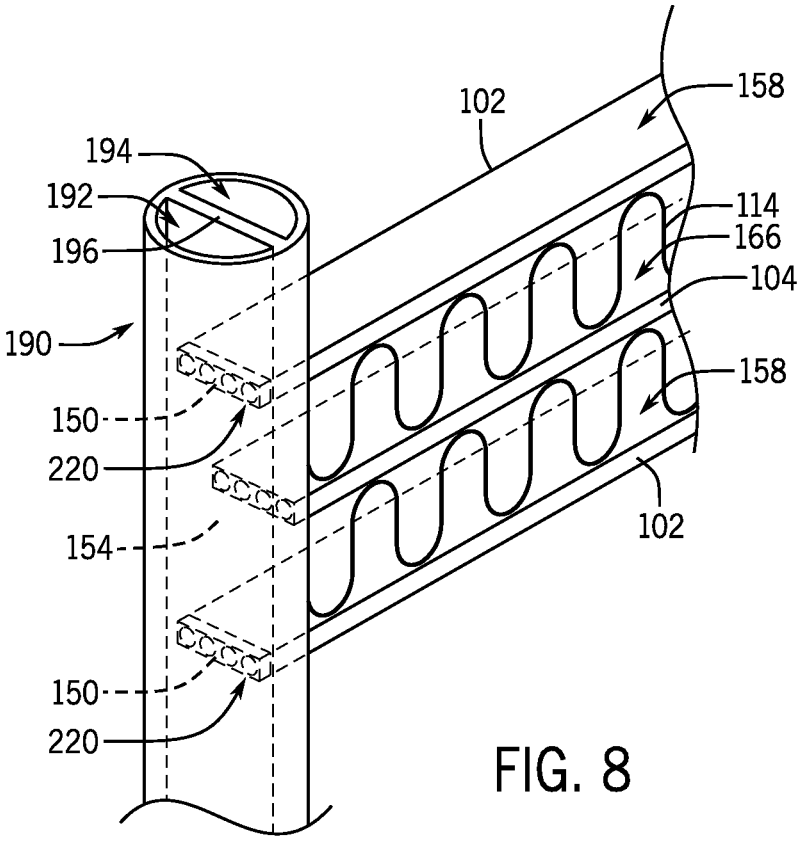
FIG. 8 is a perspective view of an embodiment of a portion of an interlaced heat exchanger having an integrated header, in accordance with an aspect of the present disclosure.

FIG. 8 is a perspective view of another embodiment of the integrated header 190 for the interlaced heat exchanger 100. For example, the integrated header 190 includes a substantially circular cross-sectional shape, such that the first passage 192 and the second passage 194 each include a semi-circular cross-sectional shape. However, in other embodiments, the integrated header 190, the first passage 192, and/or the second passage 194 may include other suitable cross-sectional shapes. As shown in the illustrated embodiment of FIG. 8, the first header connections 150 of the first set of microchannel coils 102 are in fluid communication with the first passage 192 and the second header connections 152 of the second set of microchannel coils 104 are in fluid communication with the second passage 194. For instance, the first header connections 150 extend through slots 220 of the divider 196 into the first passage 192.

Figure 9:
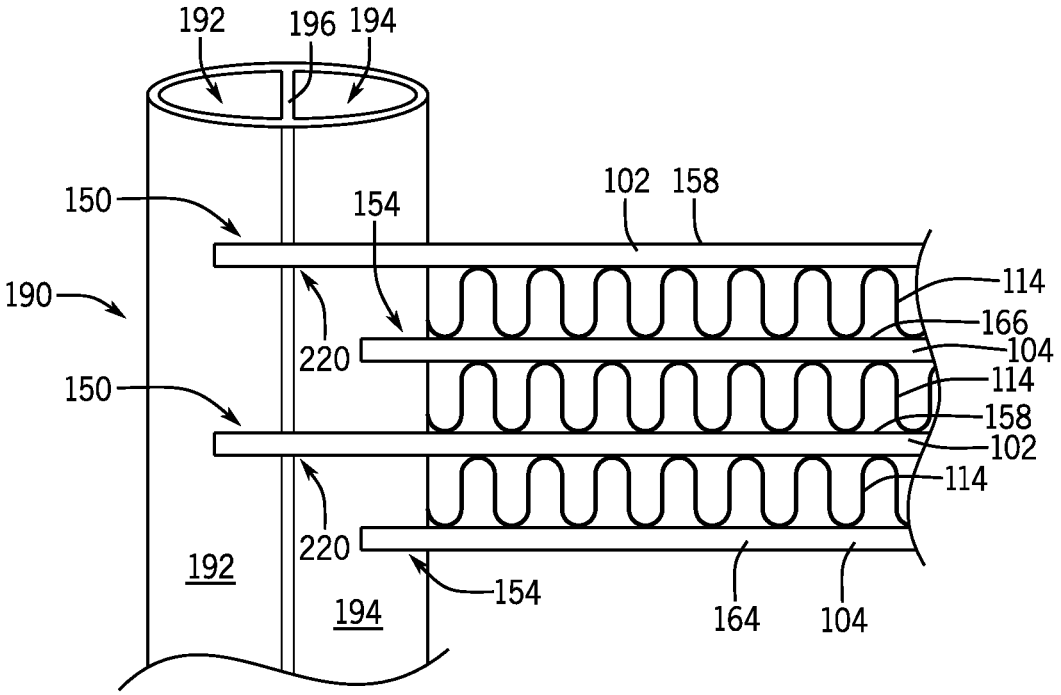
FIG. 9 is a cross-sectional side view of an embodiment of a portion of an interlaced heat exchanger, in accordance with an aspect of the present disclosure.

For example, FIG. 9 is a cross-sectional view of an embodiment of an integrated heater, such as the integrated header 190 of FIG. 8. For purposes of discussion and clarity, the embodiment of FIG. 9 includes similar elements and element numbers as the embodiment shown in FIG. 8. As shown in the illustrated embodiment of FIG. 9, the first set of microchannel coils 102 extends completely through the second passage 194 of the integrated header 190, through the slots 220 of the divider 196, and into the first passage 192, such that the first set of microchannel coils 102 is fluidly coupled to the first passage 192, but not to the second passage 194. While the first header connections 150 of the first set of microchannel coils 102 may be in contact with the working fluid flowing through the second passage 196, passageways between a surface of the second passage 196 and the first set of microchannel coils 102 may enable the working fluid to flow around the first set of microchannel coils 102 and through the header 190.

Figure 10:
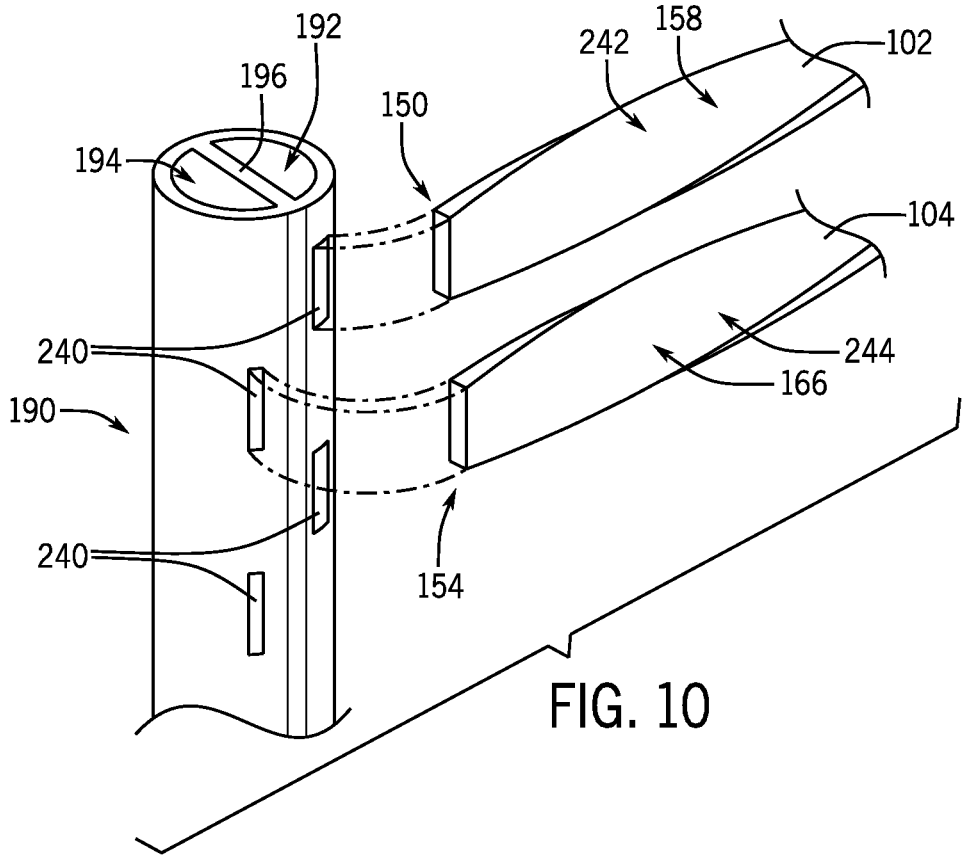
FIG. 10 is an exploded perspective view of an embodiment of a portion of an interlaced heat exchanger having an integrated header, in accordance with an aspect of the present disclosure.

In other embodiments, the first set of microchannel coils 102 may not extend through the second passage 194 of the integrated header 190. For example, FIG. 10 is an exploded perspective view of another embodiment of the integrated header 190 where the first set of microchannel coils 102 is fluidly coupled to the first passage 192 without being positioned within the second passage 194. As shown in the illustrated embodiment of FIG. 10, the first set of microchannel coils 102 and/or the second set of microchannel coils 104 may be relatively large when compared to the integrated header 190. Accordingly, the first header connection 150 and the third header connection 154 may be twisted, such that the header connections 150, 154 may be disposed within slots 240 of the integrated header 190.

In some embodiments, the first header connection 150 and the third header connection 154 may be twisted approximately 90 degrees with respect to a first surface 242 of the body portion 158 of the first set of microchannel tubes 102 and a second surface 244 of the body portion 166 of the second set of microchannel tubes 104, respectively. In other words, the first header connection 150 may be positioned in a plane that is substantially crosswise to a plane of the first surface 242 and the third header connection 154 may be positioned in a plane that is substantially crosswise to a plane of the second surface 244. Correspondingly, the slots 240 of the integrated header 190 are generally aligned with a longitudinal axis of the integrated header 190. In other embodiments, the first and third header connections 150, 154 may be twisted between 50 degrees and 150 degrees, between 70 degrees and 130 degrees, or between 80 degrees and 100 degrees with respect to the first and second surfaces 242, 244, respectively. As will be appreciated, in such circumstances, the slots 240 formed in the integrated header 190 may have an orientation that corresponds with the orientation of the header connections 150, 154.

Figure 11:
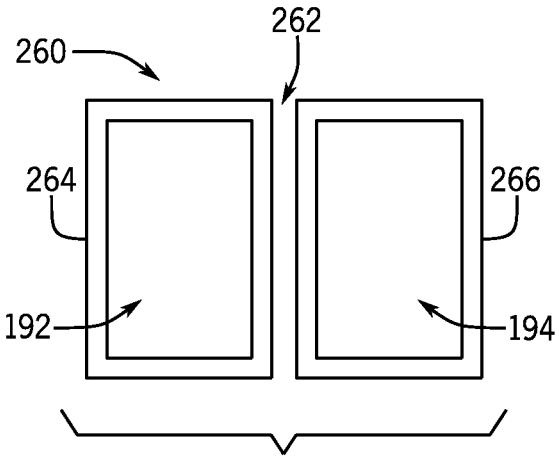
FIG. 11 is a plan view of an embodiment of a header for an interlaced heat exchanger, in accordance with an aspect of the present disclosure.
Figure 12:
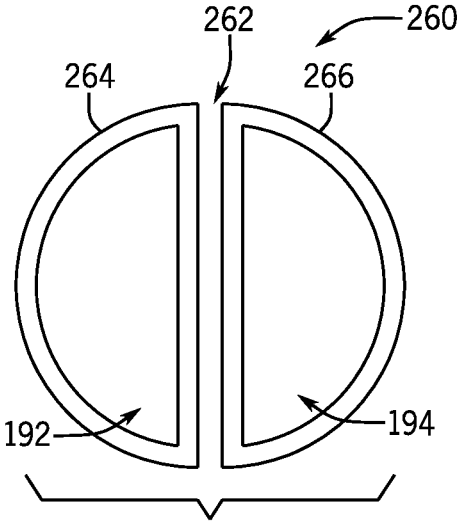
FIG. 12 is a plan view of an embodiment of a header for an interlaced heat exchanger, in accordance with an aspect of the present disclosure.

As shown in the illustrated embodiment of FIG. 10, the integrated header 190 includes the divider 196 separating the first passage 192 from the second passage 194. In other embodiments, the interlaced heat exchanger 100 may include a header 260 that includes a gap 262 between a first header portion 264 and a second header portion 266, where the first header portion 264 includes the first passage 192 and the second header portion 266 includes the second passage 194. For example, FIGS. 11 and 12 are plan views of embodiments of the header 260 having the first header portion 264 and the second header portion 266 separated by the gap 262. The gap 262 may block thermal energy transfer between the working fluid flowing through the first header portion 264 and the working fluid flowing through the second header portion 266. As such, the working fluid flowing through the first working fluid circuit and the working fluid flowing through the second working fluid circuit may not exchange significant amounts of thermal energy.

FIG. 11 is a plan view of an embodiment of the first header portion 264 and the second header portion 266, each including a substantially rectangular cross-sectional shape. Additionally, FIG. 12 is a plan view of an embodiment of the first header portion 264 and the second header portion 266 having semi-circular cross-sectional shapes. However, in other embodiments, the first header portion 264 and the second header portion 266 may include square, circular, triangular, another polygon, or any other suitable cross-sectional shapes. Additionally, the first header portion 264 and the second header portion 266 may include the same cross-sectional shape or different cross-sectional shapes. Further, a size or area of the cross-sectional shapes of the first header portion 264 and the second header portion 266 may be the same or different from one another.

The embodiments of FIGS. 6-12 generally relate to the interlaced heat exchanger 100 having the first set of microchannel coils 102 and the second set of microchannel coils 104 positioned in an alternating arrangement along the length 106 of the interlaced heat exchanger 100. In other embodiments, the first set of microchannel coils 102 and the second set of microchannel coils 104 are positioned side-by-side with respect to the axis 132. In other words, the first set of microchannel coils 102 and the second set of microchannel coils 104 are aligned relative to the axis 132 and adjacent to one another relative to a vertical axis 280 along which the length 106 of the interlaced heat exchanger 100 extends. As such, the first set of microchannel coils 102 and the second set of microchannel coils 104 overlap with one another at a common location along the length 106 of the interlaced heat exchanger 100.

Figure 13:
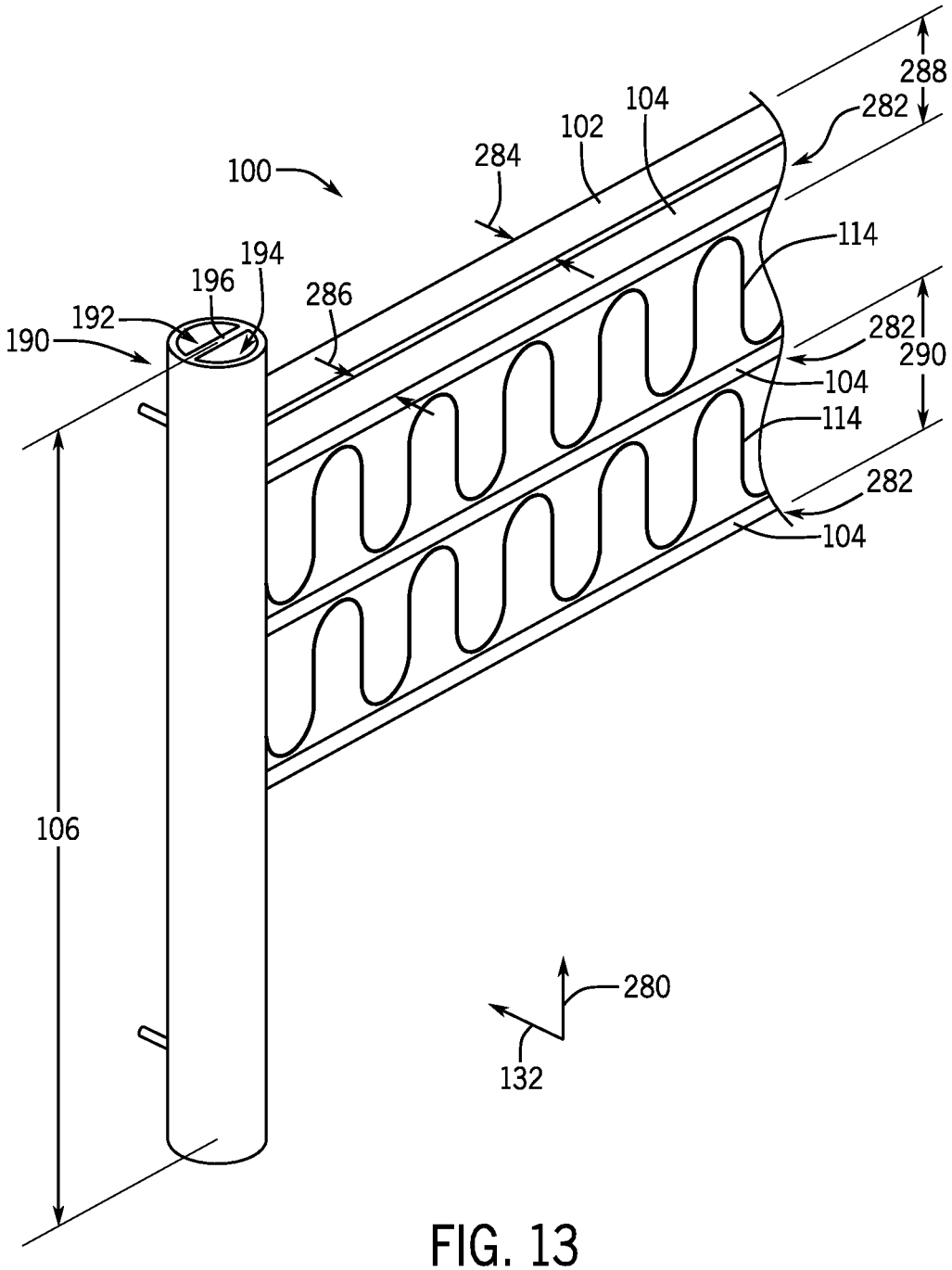
FIG. 13 is a perspective view of an embodiment of a portion of an interlaced heat exchanger, in accordance with an aspect of the present disclosure

For example, FIG. 13 is a perspective view of an embodiment of the interlaced heat exchanger 100 where the first set of microchannel coils 102 and the second set of microchannel coils 104 are substantially aligned with respect to the axis 132 and adjacent to one another relative to the vertical axis 280. Accordingly, rows 282 of coils of the interlaced heat exchanger 100 include both a microchannel coil of the first set of microchannel coils 102 and a microchannel coil of the second set of microchannel coils 104. In some embodiments, a width 284 of the first set of microchannel coils 102 and/or a width 286 of the second set of microchannel coils 104 are reduced in order to enable the first set of microchannel coils 102 and the second set of microchannel coils 104 to be positioned side-by-side without increasing a total width 288 of the interlaced heat exchanger 100. In such embodiments, a width 290 of the plurality of fins 114 may correspond with or may be generally equal to the total width 288, such that the plurality of fins 114 is coupled to both the first set of microchannel coils 102 and the second set of microchannel coils 104. In other embodiments, the width 284 of the first set of microchannel coils 102 and the width 286 of the second set of microchannel coils 104 may be sized similar to widths of the first set of microchannel coils 102 and the second set of microchannel coils 104 when the first set of microchannel coils 102 and the second set of microchannel coils 104 are arranged in the alternating pattern described above, such that a size of the integrated header 190 and the total width 288 of the interlaced heat exchanger are increased.

In the illustrated embodiment of FIG. 13, the integrated header 190 includes a circular cross-sectional shape, such that the first passage 192 and the second passage 194, each include a semi-circular cross-sectional shape. However, in other embodiments, the first passage 192 and the second passage 194 may include square, rectangular, circular, triangular, another polygon, or any other suitable cross-sectional shapes. Additionally, the first passage 192 and the second passage 194 may include the same cross-sectional shape or different cross-sectional shapes. Further, a size or area of the cross-sectional shapes of the first passage 192 and the second passage 194 may be the same or different from one another.

Figure 14:
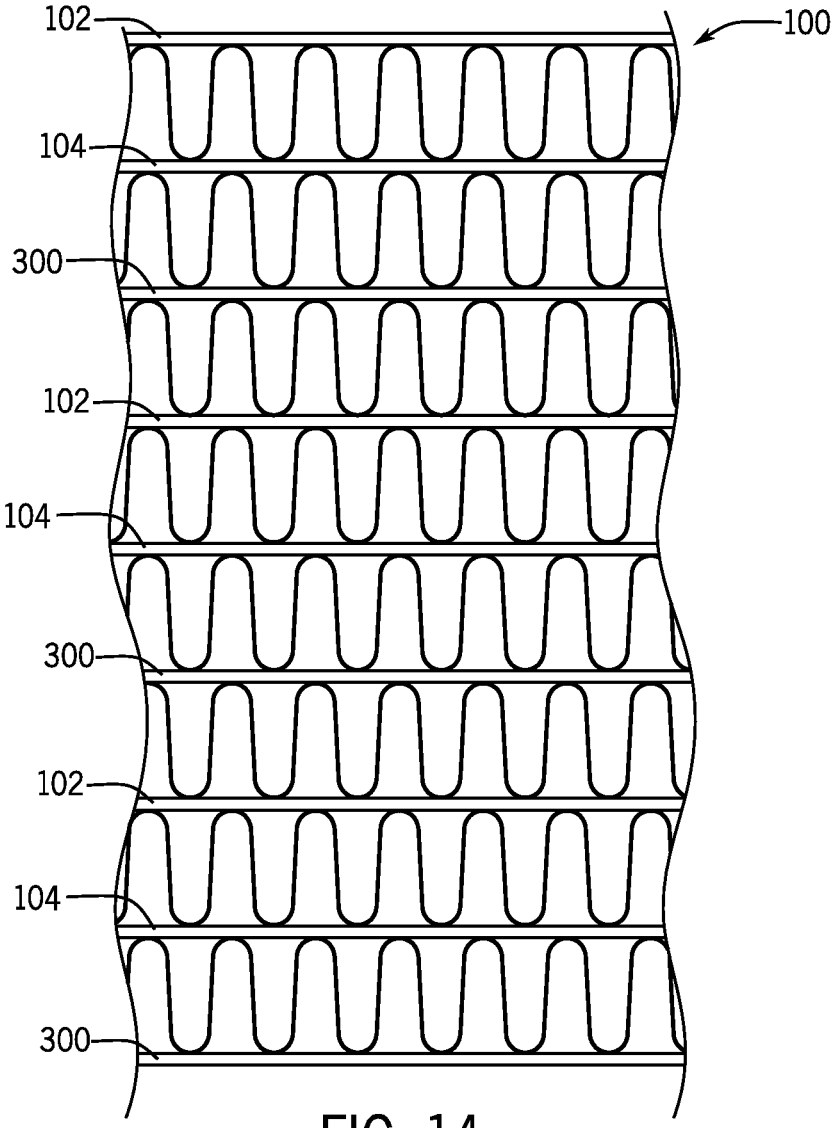
FIG. 14 is an elevation view of an embodiment of an interlaced heat exchanger, in accordance with an aspect of the present disclosure.
Figure 15:
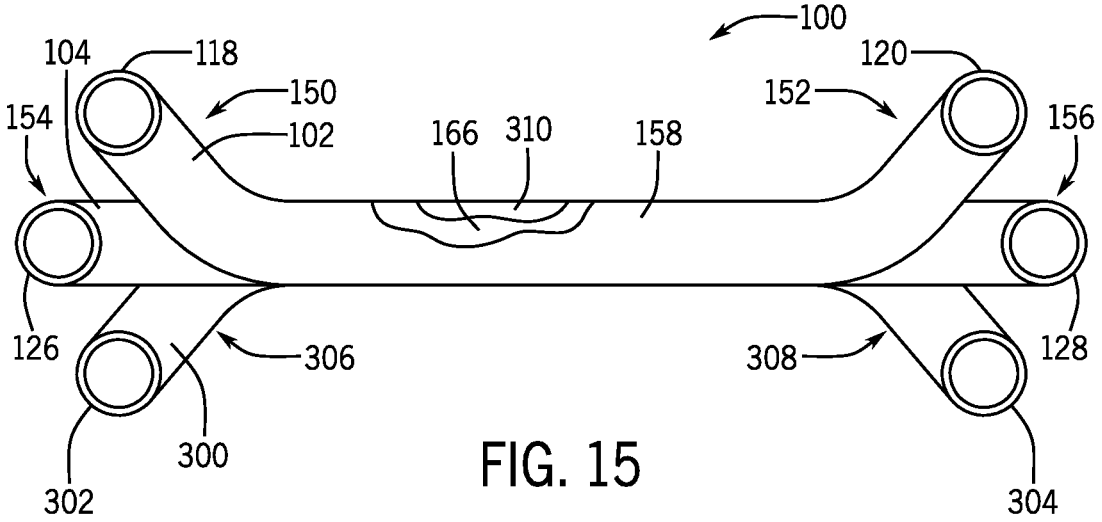
FIG. 15 is a plan view of an embodiment of a header for an interlaced heat exchanger.

As discussed above, the interlaced heat exchanger 100 may be fluidly coupled to more than two working fluid circuits. For example, FIGS. 14 and 15 illustrate embodiments of the interlaced heat exchanger 100 that is fluidly coupled to three working fluid circuits. However, it should be noted that the interlaced heat exchanger 100 may be fluidly coupled to one, two, four, five, six, seven, eight, nine, ten, or more than ten working fluid circuits. As shown in the illustrated embodiment of FIG. 14, a third set of microchannel coils 300 is interlaced with the first set of microchannel coils 102 and the second set of microchannel coils 104. The third set of microchannel coils 300 may be fluidly coupled to a third working fluid circuit, which is fluidly separate from the first working fluid circuit and the second working fluid circuit. In some embodiments, the interlaced heat exchanger 100 includes the first set of microchannel coils 102, the second set of microchannel coils 104, and the third set of microchannel coils 300 arranged in a sequence represented numerically as 1, 2, 3, 1, 2, 3, 1, 2, 3, and so forth, where the number "1" represents a microchannel coil of the first set of microchannel coils 102, the number "2" represents a microchannel coil of the second set of microchannel coils 104, and the number "3" represents a microchannel coil of the third set of microchannel coils 300. In other embodiments, the first set of microchannel coils 102, the second set of microchannel coils 104, and the third set of microchannel coils 300 may be arranged in any suitable alternating pattern or arrangement, as described above.

Further, FIG. 15 shows the first set of microchannel coils 102 fluidly coupled to the first header 118 and the second header 120, the second set of microchannel coils 104 fluidly coupled to the third header 126 and the fourth header 128, and the third set of microchannel coils 300 fluidly coupled to a fifth header 302 and a sixth header 304. In some embodiments, the first set of microchannel tubes 102 is twisted at the first header connection 150 and the second header connection 152. Additionally, the third set of microchannel tubes 300 is twisted at a fifth header connection 306 and a sixth header connection 308. Further, the third header connection 154 and the fourth header connection 156 of the second set of microchannel tubes 104 may not be twisted but remain substantially straight or linear with respect to the body portion 166 of the second set of microchannel tubes 104. This configuration of the first set of microchannel tubes 102, the second set of microchannel tubes 104, and the third set of microchannel tubes 300 may facilitate coupling the microchannel coils to the headers 118, 120, 126, 128, 302, 304.

In other embodiments, the third header connection 154 and/or the fourth header connection 156 of the second set of microchannel tubes 104 may be twisted and the first header connection 150 and the second header connection 152 of the first set of microchannel tubes 102 and/or the fifth header connection 306 and the sixth header connection 308 of the third set of microchannel tubes 300 may be straight or linear with respect to the body portion 158 of the first set of microchannel tubes 102 and/or a body portion 310 of the third set of microchannel tubes, respectively. It should be recognized that any suitable combination of the first header connection 150, the second header connection 152, the third header connection 154, the fourth header connection 156, the fifth header connection 306, and/or the sixth header connection 308 may be twisted to facilitate coupling the first set of microchannel tubes 102, the second set of microchannel tubes 104, and the third set of microchannel tubes 300 to the headers 118, 120, 126, 128, 302, and 304. In still further embodiments, the interlaced heat exchanger 100 of FIG. 15 may include an integrated header that includes three separate passages fluidly coupled to the first set of microchannel coils 102, the second set of microchannel coils 104, and the third set of microchannel coils 300, respectively.

As set forth above, embodiments of the present disclosure may provide one or more technical effects useful in increasing an efficiency of a multiple circuit system. For example, embodiments of the present disclosure are directed to an interlaced heat exchanger that is configured to increase a heat exchange surface area contacted by an airflow when a circuit of the multiple circuit system is not in operation. Further, the interlaced heat exchanger may evenly distribute an amount of thermal energy transfer to an airflow across the interlaced heat exchanger when compared to side-by-side or stacked heat exchanger coil arrangements. The interlaced heat exchanger enables substantially all of an airflow passing across the interlaced heat exchanger to be in a heat exchange relationship with an operating circuit of the interlaced heat exchanger even when a second circuit of the interlaced heat exchanger is non-operational. Further still, the interlaced heat exchanger enables simplification of a control algorithm for a fan utilized to draw the airflow across the heat exchanger. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a heat exchanger comprising:

a first set of heat exchanger tubes fluidly coupled to a first circuit of the HVAC system, wherein a first heat exchanger tube of the first set of heat exchanger tubes comprises a first body portion and a first header connection, and the first header connection extends linearly with the first body portion along a first axis; and a second set of heat exchanger tubes fluidly coupled to a second circuit of the HVAC system, wherein a second heat exchanger tube of the second set of heat exchanger tubes comprises a second body portion, a second header connection, an arcuate portion extending between the second body portion and the second header connection, and a plurality of channels extending through the second header connection, the second body portion, and the arcuate portion, the arcuate portion extends laterally beyond the first body portion of the first heat exchanger tube along a second axis that is perpendicular to the first axis, the second header connection is oriented at an oblique angle relative to the second body portion, and the second body portion and the second header connection extend within a common plane, wherein the first set of heat exchanger tubes and the second set of heat exchanger tubes are disposed in an alternating arrangement along a length of the heat exchanger such that the first set of heat exchanger tubes and the second set of heat exchanger tubes are interlaced in the heat exchanger.

2. The HVAC system of claim 1, comprising a first header coupled to the first header connection of the first heat exchanger tube and a second header coupled to the second header connection of the second heat exchanger tube.

3. The HVAC system of claim 1, comprising a third set of heat exchanger tubes fluidly coupled to a third circuit of the HVAC system, wherein a third heat exchanger tube of the third set of heat exchanger tubes comprises a third body portion, a third header connection, and an additional arcuate portion extending between the third body portion and the third header connection, the third header connection is oriented at an additional oblique angle relative to the third body portion, the third header connection and the third body portion extend within an additional common plane, and the first set of heat exchanger tubes, the second set of heat exchanger tubes, and the third set of heat exchanger tubes are disposed in an alternating arrangement along the length of the heat exchanger.

4. The HVAC system of claim 3, wherein the arcuate portion of the second heat exchanger tube extends from a first side of the first body portion of the first heat exchanger tube, and the additional arcuate portion of the third heat exchanger tube extends from a second side, opposite the first side, of the first body portion.

5. The HVAC system of claim 1, wherein the first body portion overlaps with the second body portion.

6. The HVAC system of claim 1, comprising a plurality of fins extending between the first heat exchanger tube and the second heat exchanger tube.

7. The HVAC system of claim 1, wherein the first circuit and the second circuit are fluidly separate from one another.

8. The HVAC system of claim 1, wherein the first set of heat exchanger tubes, and the second set of heat exchanger tubes comprise microchannel tubes.

9. An interlaced heat exchanger, comprising:

a first set of heat exchanger tubes, wherein a first heat exchanger tube of the first set of heat exchanger tubes comprises a first body portion and a first header connection extending along a first axis; and a second set of heat exchanger tubes, wherein a second heat exchanger tube of the second set of heat exchanger tubes comprises a second body portion, a second header connection oriented obliquely relative to the second body portion via an arcuate portion of the second heat exchanger tube, and a plurality of channels formed in the second heat exchanger tube and extending through the second header connection, through the second body portion, and through the arcuate portion, the arcuate portion extends laterally beyond the first body portion of the first heat exchanger tube along a second axis oriented perpendicular to the first axis, and the second body portion and the second header connection are in a common plane, wherein the first set of heat exchanger tubes and the second set of heat exchanger tubes are disposed in an alternating arrangement along a length of the interlaced heat exchanger such that the first set of heat exchanger tubes and the second set of heat exchanger tubes are interlaced.

10. The interlaced heat exchanger of claim 9, comprising a first header coupled to the first header connection and a second header coupled to the second header connection, wherein the first header is configured to direct a first working fluid of a first working fluid circuit into the first set of heat exchanger tubes, and the second header is configured to direct a second working fluid of a second working fluid circuit into the second set of heat exchanger tubes.

11. The interlaced heat exchanger of claim 10, comprising a third set of heat exchanger tubes and a third header, wherein a third heat exchanger tube of the third set of heat exchanger tubes comprises a third body portion and a third header connection oriented obliquely relative to the third body portion via an additional arcuate portion of the third heat exchanger tube, and the third header is coupled to the third header connection and is configured to direct a third working fluid of a third working fluid circuit into the third set of heat exchanger tubes.

12. The interlaced heat exchanger of claim 11, wherein the second header is positioned at a first side of the first body portion of the first heat exchanger tube, and the third header is positioned at a second side, opposite the first side, of the first body portion.

13. The interlaced heat exchanger of claim 9, wherein the second body portion of the second heat exchanger tube overlaps with the first body portion of the first heat exchanger tube.

14. The interlaced heat exchanger of claim 9, wherein the first heat exchanger tube comprises a third header connection extending along the first axis.

15. The interlaced heat exchanger of claim 9, wherein the second heat exchanger tube comprises a third header connection oriented obliquely relative to the second body portion via an additional arcuate portion of the second heat exchanger tube, wherein the third header connection is in the common plane.

16. A heating, ventilation, and air conditioning (HVAC) system, comprising:

a first working fluid circuit configured to circulate a first working fluid;

a second working fluid circuit configured to circulate a second working fluid; and a heat exchanger fluidly coupled to the first working fluid circuit and the second working fluid circuit, the heat exchanger comprising:

a first set of heat exchanger tubes comprising a first heat exchanger tube, wherein the first heat exchanger tube comprises a first body portion and first header connections at opposite ends of the first body portion, the first body portion extends linearly along a first axis between the first header connections, and the first set of heat exchanger tubes is configured to receive the first working fluid from the first working fluid circuit; and a second set of heat exchanger tubes comprising a second heat exchanger tube, wherein the second heat exchanger tube comprises a second body portion, second header connections at opposite ends of the second body portion, respective arcuate portions extending between the second header connections and the second body portion, and a plurality of channels formed in the second heat exchanger tube, the plurality of channels extends through the second header connections, through the second body portion, and through the respective arcuate portions, the second header connections and the second body portion extend within a common plane, the respective arcuate portions extend laterally beyond the first body portion of the first heat exchanger tube along a second axis extending perpendicularly relative to the first axis, the second set of heat exchanger tubes is configured to receive the second working fluid from the second working fluid circuit, and the first set of heat exchanger tubes and the second set of heat exchanger tubes are disposed in an alternating arrangement along a length of the heat exchanger such that the first set of heat exchanger tubes and the second set of heat exchanger tubes are interlaced with one another.

17. The HVAC system of claim 16, wherein the heat exchanger comprises:

a first header fluidly coupled to the first set of heat exchanger tubes and configured to receive the first working fluid from the first working fluid circuit; and a second header fluidly coupled to the second set of heat exchanger tubes and configured to receive the second working fluid from the second working fluid circuit.

18. The HVAC system of claim 16, wherein the first body portion and the second body portion overlap with one another.

19. The HVAC system of claim 16, comprising a fan configured to direct an airflow across the first set of heat exchanger tubes and the second set of heat exchanger tubes.

20. The HVAC system of claim 16, wherein the second header connections are disposed on a common side of the first body portion of the first heat exchanger tube.

* * * * *